US005960547A

United States Patent [19]

Bedard

[11] Patent Number: 5,960,547

[45] Date of Patent: Oct. 5, 1999

[54] RADIUS CUTTER WITH GUIDE

[76] Inventor: Ronald Bedard, 8921 W. Fargo Dr., Peoria, Ariz. 85382

[21] Appl. No.: 09/028,563

[22] Filed: Feb. 24, 1998

[51] Int. Cl.[6] ..... B26B 1/08; B26B 29/00

[52] U.S. Cl. ..... 30/293; 30/294

[58] Field of Search ..... 30/286, 289, 293, 30/294

[56] References Cited

U.S. PATENT DOCUMENTS

| | | | |
|---|---|---|---|
| 2,853,778 | 9/1958 | Pratt et al. . | |
| 4,041,605 | 8/1977 | Selfridge | 30/293 |
| 4,408,396 | 10/1983 | Scholl | 30/294 |
| 4,501,069 | 2/1985 | Kohno | 30/293 |
| 4,667,409 | 5/1987 | D'Amato | 30/289 |
| 5,231,764 | 8/1993 | Chang | 30/293 |
| 5,265,342 | 11/1993 | Lang, Jr. | 30/294 |
| 5,325,595 | 7/1994 | Marlin | 30/294 |
| 5,349,760 | 9/1994 | DeVito | 30/294 |
| 5,450,672 | 9/1995 | Fortin | 30/294 |

*Primary Examiner*—Hwei-Siu Payer

*Attorney, Agent, or Firm*—Squire, Sanders & Dempsey L.L.P.

[57] ABSTRACT

A cutting tool for cutting wall hanging material lying close to curved surfaces is disclosed. The cutting tool has a handle and a base. A blade is mounted on the base and is secured thereon by a retaining guard. The guard is rotatable around a post to a first position exposing the cutting edge of the blade and to a second position covering the blade. A guide is connected to the handle in a spaced apart position by a bolt which is securely attached on one end to the handle. The distance between the guide and the handle is adjusted by appropriately positioning the guide along the axis of the bolt. The guide is spaced a predetermined distance and fixed in the desired position with respect to the blade by a bolt engaging a threaded aperture in the guide and secured by a wing nut.

19 Claims, 2 Drawing Sheets

RADIUS CUTTER WITH GUIDE

TECHNICAL FIELD

The present invention relates to the field of cutting tools and, more particularly, to the field of hand held cutting tools for cutting flexible wall hanging material. Still more particularly, the present invention discloses a cutter having a guide that assists the user in cutting the wall hanging material with precision in installations with curved wall surfaces and those having a molding.

BACKGROUND OF INVENTION

The installation of flexible thin sheets of wall hanging material such as wallpaper, fabric and other similar material on walls is well known. Furthermore, cutters used for trimming or otherwise cutting the material for aesthetic purposes are well known.

U.S. Pat. No. 4,501,069 to Kohno discloses a cutter for wallpaper. The cutter has a triangular grip and a sheath embedded therein for holding a cutting blade. A base of the triangle defines a slide edge that has a "V" shaped cross section symmetrical with respect to a phantom plane containing the cutting blade. The cutter is suitable for uniformly trimming edges of the wallpaper extending on a baseboard without requiring the use of a ruler.

U.S. Pat. No. 4,408,396 to Scholl discloses a hand operated tool for cutting and trimming wall covering material. It includes a pair of matching half sections forming an elongated handle and a blade holding socket which is disposed in angular relation to the major axis of the handle. The tool includes a quick disconnect anchor device wherein a single spring biased pin which is moveable transversely through the walls of the blade-holding socket and an opening formed in the blade for locking the blade in operating position.

U.S. Pat. No. 4,041,605 to Selfridge discloses a hand operated tool for cutting wallpaper along a joint between a wall which is being papered and an adjacent structure. The tool includes a guide portion with a conical body for resting against the adjacent structural member and gradually feeding the wallpaper into the joint. The tool includes a flat flange for placement against the wall being papered and pressing the paper smoothly against the wall. A blade is mounted in a receptacle and secured by a releasable fastener. The blade is oriented at an angle to the flange. An elongated handle is mounted at the base of the body member for manipulating the tool.

A wallpaper trimmer is also disclosed in U.S. Pat. No. 2,853,778 to Pratt et al. The trimmer includes a head portion and a handle portion. The tool includes guide surfaces diverging at the center plane of the head portion at an angle substantially 90 degrees to guide the trimmer along a 90 degree wall intersection. Furthermore, it includes a blade holder to hold the blade in a fixed position.

In the past, most wall surfaces were flat and the transition from one surface to another was made with an intersection forming an angle of 90 degrees. Furthermore, the transition from a wall surface to a ceiling or to a floor board was also made at a right angle. Accordingly, in most cases the trimming of the wall hanging material was done at the intersection of the surfaces by using the adjacent wall surface as a guide or by pressing the blade on the intersection line itself. Recently, however, the use of walls with curved surfaces and/or curved transitions from one wall surface to another has become very common. Therefore, it is necessary to cut or otherwise trim wall hanging material on the curved surfaces. Because of the nature of the surfaces, such cutting or trimming is difficult to perform with precision with any of the cutters used in the past. The present invention, discloses a cutter for trimming or cutting wall hanging material on curved wall surfaces with ease and precision. The cutter includes a guide for accurately guiding a blade along the cutting line to effect a precise trimming which is aesthetically desirable in a wall installation. Furthermore, the tool includes a guard that can be easily positioned so as to cover the cutting edges of the tool to prevent injuries or other damage when the tool is not being used.

These and other objects and advantages of the present invention will become apparent from the following description.

SUMMARY OF THE INVENTION

A cutting tool for trimming or cutting wall hanging material is disclosed. The tool includes an elongated handle with a base depending therefrom. Two pegs and a threaded middle post extend from the base for mounting a razor blade thereon. The blade is removably secured on the base by a retaining guard which has openings for receiving the pegs and the post, and which sandwiches the blade therebetween. The guard is securely mounted on the base to lock the blade in the cutting position by a locking nut threadedly affixed to the post. The retaining guard is suitably shaped and sized to expose and to allow the cutting edge of the blade to extend beyond the guard to allow it to cut during the cutting operation when the retaining guard is in a first, protracted locking position. The guard is also suitably shaped and sized so that, upon a one hundred and eighty degree rotational movement of the blade around the post from the first locking position to a second, retracted locking position, the guard covers the blade and prevents injury when not in use.

A guide is connected to the handle in a spaced apart position by a bolt post which is securely attached on one end to the handle. The distance between the guide and the handle is adjusted by appropriately positioning the guide along the axis of the bolt. The guide is releasably slidably fixed in the desired position by a wing nut and threaded combination.

BRIEF DESCRIPTION OF THE DRAWING

For a detailed description of the invention reference will be made to accompanying drawings wherein.

DESCRIPTION OF THE PREFERRED EMBODIMENT

Figure 1:
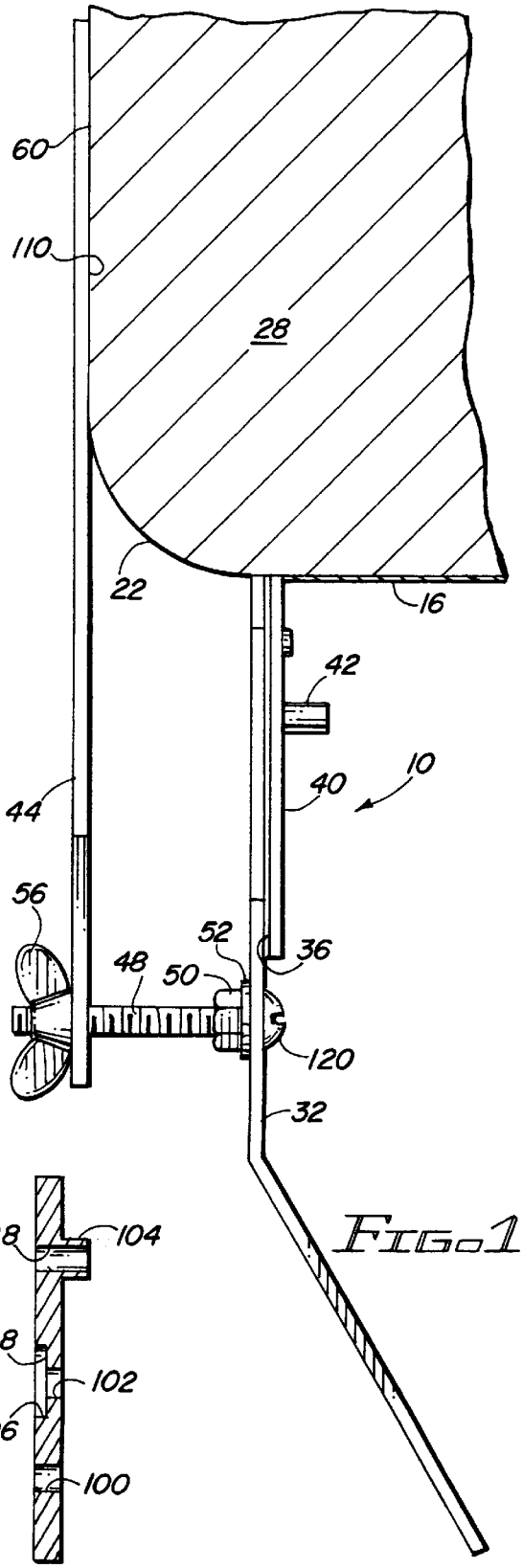
FIG. 1 is a side view showing the cutting tool of the present invention.

As used herein the term "wall hanging material" means any flexible thin sheet material installed on walls or similar structures for decoration or for other purposes, including wall paper, fabric, vinyl or the like. Referring to FIG. 1, there is shown a cutting tool 10 for cutting or trimming a wall hanging material 16 which is installed on a curved edge 22 of a wall 28. In the following description, like parts are marked throughout the specification and drawing with the same reference numerals. The drawing figures are not necessarily to scale and certain features of the invention may be shown in exaggerated scale in the interest of clarity. Cutting tool 10 includes a body 32, a blade 36, a retaining guard 40, a lock nut or blind lock nut 42, a guide 44, an elongated threaded bolt post 48, a lock nut 56, a washer 52 and a wing nut 56. Guide 44 abuts a flat surface 60 of wall 28 and is slidable thereon for a sliding movement in a direction to guide blade 36 of tool 10 along edge 22 to cut or trim wall paper 16 in a straight line (out of the plane of the paper of FIG. 1).

Figure 2:
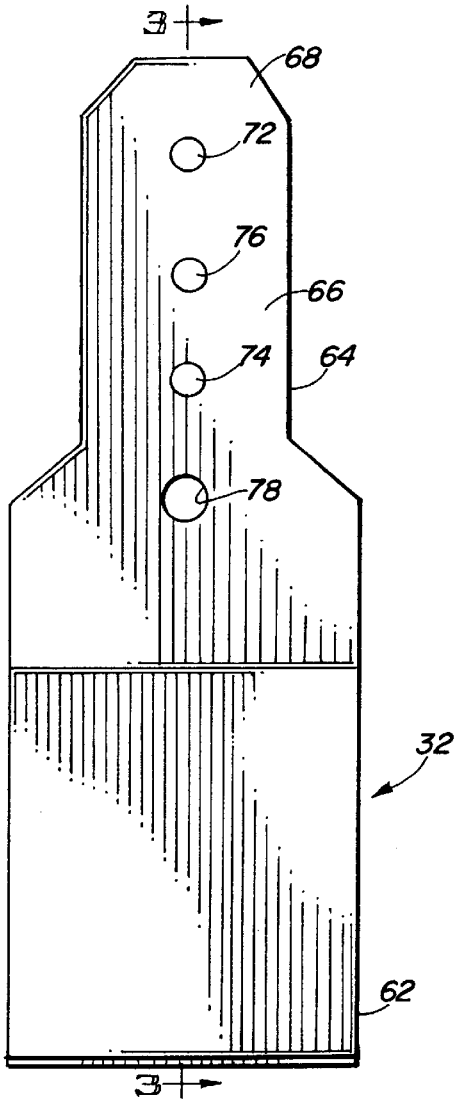
FIG. 2 is a top view of the base portion of the cutting tool of FIG. 1.
Figure 6:
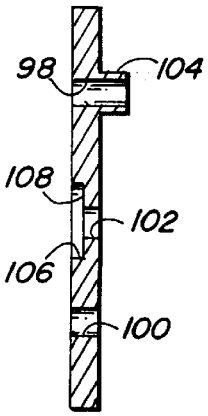
FIG. 6 is a cross-sectional view taking along the plane of line 6—6 in FIG. 5.
Figure 3:
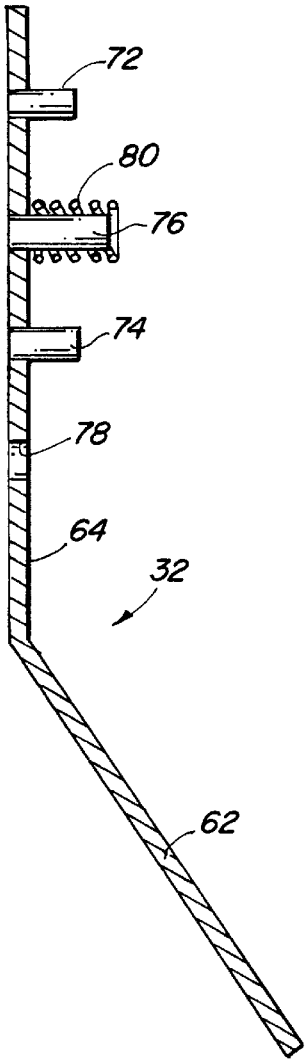
FIG. 3 is a partial cross-sectional view taken along the plane of line 3—3 in FIG. 2.

Referring now to all the figures, and in particular FIGS. 2 and 3, a body 32 includes a handle portion 62 and a flat base 64 depending from handle portion 62 at an angle thereto and having a reduced width portion 66 and a tapered end 68. Extensions formed by pegs 72 and 74 and threaded post 76 extend perpendicularly from base 64 for receiving blade 36 (not shown in FIG. 2). Flat base 64 further includes an opening 78 for inserting bolt 48 (not shown in FIG. 2) therethrough. FIG. 3 shows a cross section of body 32 having handle portion 62, base 64 depending therefrom in an angular configuration, the base 64 having an engagement member in the forms of pegs 72 and 74, threaded post 76 and opening 78 to receive the cutting blade 36, which has at least three apertures 88, 90, 9 vertically aligned, with north and south apertures 88, 90 to receive pegs 72 and 74, and a center aperture 92 to receive threaded post 76 and rotate about post 76. A spring 80 is received over post 76 to spring bias against shoulder 108 (as shown in FIG. 6) of retaining guard 40. A lock nut 42 is threadedly attached to post 76 to lock blade 36 and retaining guard 40 onto base 64. Various alignment ridges such as rim 104 help align and orient the retaining guard 40.

Figure 5:
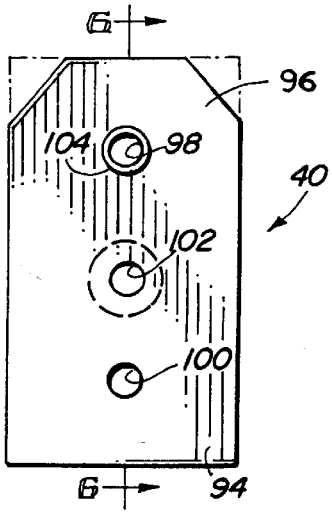
FIG. 5 is a top view of a retaining blade guard used in the cutting tool of FIG. 1.
Figure 4:
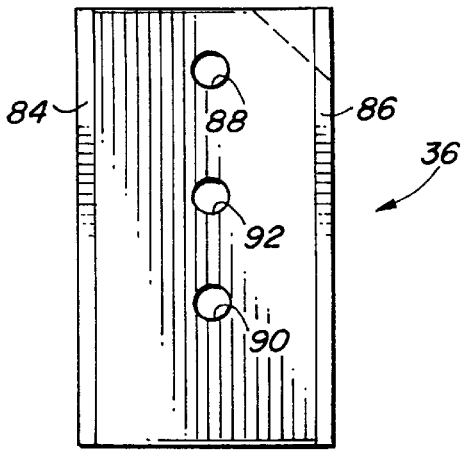
FIG. 4 is a top view of a blade used in the cutting tool of FIG. 1.

FIG. 4 shows blade 36 having two opposite cutting edges 84 and 86 and apertures 88 and 90 for receiving pegs 72 and 74, respectively, and aperture 92 for receiving post 76. Referring now to FIG. 5, retaining guard 40 is a generally flat member having a generally rectangular end 94 and an opposite tapered end to conform to the tapered end 68 of the body 32, and to allow the cutting corners of the razor blade 36 to protrude at the tapered end. Guard 40 is removably and releasably mounted to the flat base body portion 64 of body 32. Guard 40 includes holes 98, 100 and 102 for receiving peg 72, peg 74 and post 76, respectively. A rim 104 extends from hole 98 in tandem therewith. FIG. 6 shows a cross section of retaining guard 40 taken along line 6—6 of FIG. 5 with holes 98, 100 and 102 extending therethrough and rim 104 in tandem with hole 98. Hole 102 includes an increased diameter portion 106 suitably sized to receive one end of spring 80 and to provide a shoulder 108 for abutting that end of spring 80.

Figure 7:
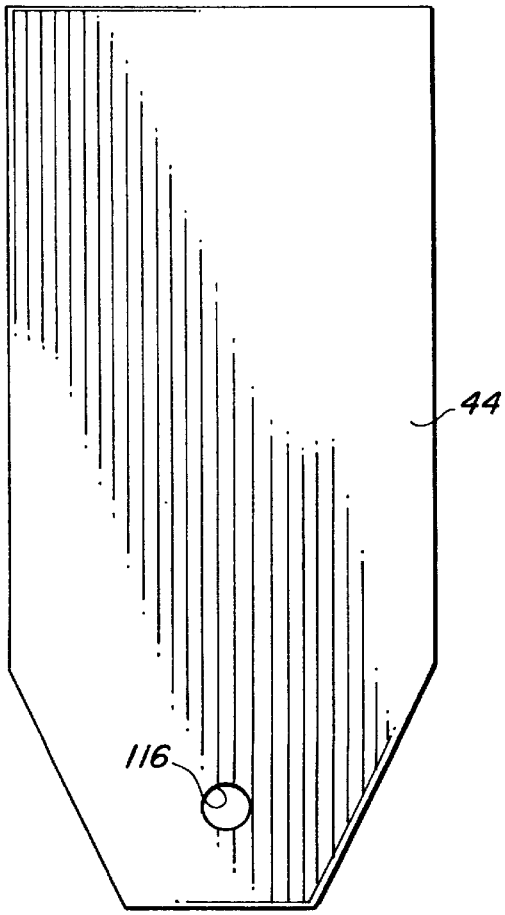
FIG. 7 is a front view of the guide of the cutting tool of FIG. 1.

Guide 44 is shown in FIG. 7. Guide 44 is generally flat to provide a flat guiding surface 110 that abuts flat surface 60 (shown in FIG. 2) and it includes a threaded opening 116 for receiving connector bolt 48, shown in FIG. 1, in a fixed but adjustable manner. Guide 44 has a guiding plane surface 110 that abuts the wall and forms a parallel surface from the cutting tip plane formed by the cutting element of blade 36, spaced a predetermined distance from the cutting element by nature of bolt 48 cooperating with the wing nut 56 and guide 44. The predetermined distance is adjusted by the user of the cutting tool 10, by rotating wing nut 56 and/or bolt head 120, thereby spacing the guiding surface 110 from the cutting blade plane.

Referring now to FIGS. 1 through 6, in the assembled position, blade 36, having cutting edges 84, 86, is suitably positioned on base 64 so that holes 88 and 90 passing through the blade receive pegs 72 and 74, respectively, and hole 92 receives threaded post 76. Spring 80 is received over post 76 so that one end thereof abuts blade 36. Then, retaining guard 40 is suitably attached to base 64, and the blade 36 is sandwiched in between, by inserting post 76 through hole 102 and pegs 72 and 74 through holes 98 and 100, respectively. Spring 80 is inserted in increased diameter portion 106 of hole 102 and abuts shoulder 108. Post 76 extends beyond the outer surface of retaining guard 40 and lock nut 42 is threadedly attached to post 76. Lock nut 42 is threadedly advanced on post 76 until it securely locks blade 36 and retaining guard 40 on base 64. In that position, tapered end 96 of retaining guard 40 is in tandem with tapered end 68 of base 64 and a portion of edges 86 and 84 of blade 36 is exposed for use. Other locking devices, such as a snap fit locking arrangement or other suitable locking mechanism may be used in lieu of the lock nut 42 engaging a post 76 as shown in the preferred embodiment.

When not in use, the exposed portions of blade 36 may be covered by rotating the blade from a protracted to a retracted postition, in order to avoid accidental cutting or injuries, by loosening lock nut 42, then rotating retaining guard 40 one hundred and eighty degrees around post 76, inserting pegs 72 and 74 in apertures 100 and 98, respectively, and finally tightening lock nut 42. In that retracted position, rectangular end 94 of retaining guard 40 covers the exposed portion of blade 36 and no cutting can be effected by blade 36.

Referring now to FIGS. 1 through 7, guide 44 is connected to body 32 by inserting threaded bolt 48 in opening 78 of base 64, washer 52, lock nut 50, opening 116 of guide 44 and wing nut 56. Opening 116 of guide 44 is threaded with the same pitch thread as the threads on bolt 48, so that the bolt is screwed through the opening 116 and thus slidably secured thereto in a fixed manner. Lock nut 50 is threadingly advanced towards bolt head 120 of bolt 48 to tighten the connection between bolt 48 and body 32. The position of guide 44 with respect to body 32 is slideably adjusted along the axis of bolt 48 by threadingly advancing or retracting wing nut 56 on bolt 48, as well as screwing bolt head 120. In the connected position, guiding surface 110 of guide 44 is substantially parallel with blade 36.

In operation, after the trimming or cutting location is identified, the relative position of guide 44 with respect to body 32 is adjusted to conform it therewith. Then guide 44 is placed on surface 60 and the tip of blade 36 is placed on the cutting position. Guide 44 maintains tool 10 a user predetermined spaced and aligned distance from the surface edge 60 as tool 10 is manually moved downwards, while trimming or cutting the wall hanging material with precision at the required location. The trimming or cutting line followed by blade 36 while cutting the the wall hanging material is parallel with guiding surface 110 of guide 44.

The components of tool 10 are constructed of well known material suitable for providing strength and durability in the environment wherein tool 10 is used. Guide 44 is constructed of either wood or plastic material. The remaining parts are preferably constructed of metal material.

While a preferred embodiment of the present invention has been shown and described, modifications thereof can be made by one skilled in the art without departing from the spirit of the invention.

What is claimed is:

1. A cutting tool for cutting wall hanging material, comprising:

a body having a handle portion and a base, the handle portion having an opening therethrough;

a first peg, a second peg and a threaded post extending from the base;

a blade having a first cutting edge and being mounted on the base, the blade having a first aperture for receiving the first peg, a second aperture for receiving the second peg and a third aperture for receiving the post;

a retaining guard having a first hole for receiving the first peg, a second hole for receiving the second peg and a third hole for receiving the post;

a nut threadingly mounted on the post;

a spring disposed over the post and having one end abutting the blade and the other end abutting the retaining guard;

a guiding member having a flat guiding surface and a guiding member aperture, the guiding member aperture having threads;

a threaded bolt threaded through the guiding member aperture on one end and through the handle portion opening on the other end and having a bolt head;

a wing nut threadingly disposed over the threaded bolt;

a lock nut threadingly disposed over the threaded bolt between the handle portion and the guiding member; and a washer disposed over the bolt between the lock nut and the handle.

2. A cutting tool according to claim 1, wherein the blade further has a second cutting edge opposite the first cutting edge.

3. A cutting tool, comprising:

(a) a body;

(b) a cutting element, mounted on the body, comprising a first cutting tip;

(c) a guide comprising:

(1) a threaded orifice; and (2) a guiding surface coupled to the body to space the cutting tip apart from the guiding surface and substantially parallel to the guiding surface;

(d) a base comprising an elongated bar, the bar being angled to define:

(1) a handle portion at one end; and (2) an engaging portion, at an opposite end, having an engagement member for engaging the cutting element; and (e) a bolt, connected at one end to the base and to the other end to the guide, the bolt being threaded through the threaded orifice to couple the guide to the body.

4. A cutting tool according to claim 3, further comprising:

a wing nut, the wing nut secured to the bolt at the end of the bolt passing through the threaded orifice, to slidably fix the guide to the bolt.

5. A cutting tool according to claim 3, wherein:

(a) the engagement member includes a plurality of extensions, one of the extensions being a threaded center post and the connector connecting the guide comprises a threaded bolt and locking nut, the guide slideably affixed to the threaded bolt and secured by the locking nut;

(b) the tool further comprises a retaining guard for retaining the cutting element the retaining guard being removeably mounted on the body; and (c) the retaining guard includes a guard connector for attaching the guard to the engagement member.

6. A cutting tool according to claim 5, wherein:

(a) the plurality of extensions comprises at least three extensions, with two pegs in-line with the threaded center post to receive the cutting element;

(b) the cutting element being a razor having at least three apertures for receiving the three extensions;

(c) the retaining guard includes a threaded nut releaseably secured to the threaded center post; and (d) the cutting element is sandwiched between the body and the retaining guard, and the retaining guard may pivot about the threaded center post to allow the cutting element to pivot from a cutting position to a retracted position.

7. A cutting tool according to claim 3, wherein the cutting element further comprises a second cutting tip.

8. A cutting tool comprising:

(a) a body having a cutting element mounted thereon;

(b) a guide having a guiding surface, the guide being coupled to the body in a spaced apart position;

(c) a base comprising an engagement member that includes a plurality of extensions; and (d) a retaining guard removeably mounted on the body, the retaining guard including a guard connector for attaching the guard to the engagement member.

9. A cutting tool according to claim 8, wherein:

(a) the engagement member comprises three posts aligned in a line, the posts comprising a threaded center post;

(b) the cutting element has a plurality of at least three apertures aligned in a line to receive the posts;

(c) the guard connector includes a threaded nut releaseably secured to the threaded center post; and (d) the cutting element is sandwiched between the body and the retaining guard.

10. A cutting tool according to claim 9, further including:

a spring between the cutting element and the retaining guard.

11. A cutting tool according to claim 10, further including:

(a) a threaded bolt for slideably affixing to the guide; and (b) a locking nut for securing the guide a predetermined space apart from the body.

12. A cutting tool according to claim 11, wherein:

(a) the guiding surface defines a guiding plane; and (b) the cutting element has a cutting tip, the cutting tip being in a plane which is separate and apart from the guiding plane by the predetermined distance and parallel to the guiding plane.

13. A cutting tool according to claim 8, wherein the cutting element comprises a blade having opposite cutting edges.

14. A cutting tool comprising:

(a) a body comprising:

(1) a cutting element mounted on the body;

(2) an engagement member for engaging the cutting element; and (3) an elongated bar having a handle portion at one end and a base portion at an opposite end for the engagement member, the base portion having a tapered tip of a smaller width than the handle portion; and (b) a guide having a guiding surface, the guide being adjustably coupled to the body so as to be placed a predetermined space apart from the body.

15. A cutting tool according to claim 14, wherein:

(a) the engagement member includes a plurality of extensions, (b) the tool further includes a retainer guard for retaining the cutting element, the retainer guard being releasably mounted on the base portion.

16. A cutting tool according to claim 14, wherein:

(a) the plurality of extensions comprises three extensions, consisting of two pegs and a threaded center post, to receive the cutting element;

(b) the cutting element is a razor having three apertures for receiving the three extensions;

(c) the retainer guard includes a threaded nut releasably secured to the threaded center post; and (d) the cutting element is sandwiched between the body and the retainer guard, and the retainer guard may pivot about the threaded center post to allow the cutting element to pivot from a cutting position to a retracted position.

17. A cutting tool according to claim 15, further including:

a connector connecting the guide to the body to space the guide a predetermined space apart from the body.

18. A cutting tool according to claim 17, wherein:

the connector is a threaded bolt and locking nut, and wherein the guide has a threaded aperture, the threaded aperture receiving the threaded bolt.

19. A cutting tool according to claim 14, wherein the cutting element comprises a blade having opposite cutting edges.

* * * * *